US006857803B2

(12) United States Patent
Smith

(10) Patent No.: US 6,857,803 B2
(45) Date of Patent: Feb. 22, 2005

(54) PRINTING SYSTEM WEB GUIDE WITH A REMOVABLE PLATEN

(75) Inventor: Daniel E. Smith, Bristol, NH (US)

(73) Assignee: Vutek, Inc., Meredith, NH (US)

( * ) Notice: Subject to any disclaimer, the term of this patent is extended or adjusted under 35 U.S.C. 154(b) by 0 days.

(21) Appl. No.: 10/058,813

(22) Filed: Jan. 28, 2002

(65) Prior Publication Data

US 2002/0168206 A1 Nov. 14, 2002

Related U.S. Application Data

(63) Continuation-in-part of application No. 10/040,894, filed on Jan. 7, 2002, now abandoned.
(60) Provisional application No. 60/260,308, filed on Jan. 8, 2001.

(51) Int. Cl.[7] ..... B41J 11/02
(52) U.S. Cl. ..... 400/656; 400/23; 400/648
(58) Field of Search ..... 347/102; 400/648, 400/649, 656, 23, 29, 48

(56) References Cited

U.S. PATENT DOCUMENTS

| | | | |
|---|---|---|---|
| 3,955,737 A | 5/1976 | Traise | |
| 3,977,588 A | 8/1976 | Meade et al. | |
| 3,995,548 A | 12/1976 | Mitter | |

(List continued on next page.)

FOREIGN PATENT DOCUMENTS

| | | | | |
|---|---|---|---|---|
| EP | 1044817 A2 | * | 10/2000 | ..... B41J/11/00 |
| JP | 05084991 A | * | 4/1993 | ..... B41J/11/14 |
| JP | 05131620 A | * | 5/1993 | ..... B41J/2/015 |
| JP | 06182988 A | * | 7/1994 | ..... B41J/2/01 |
| JP | 08142321 A | * | 6/1996 | ..... B41J/2/01 |
| JP | 11207944 A | * | 8/1999 | ..... B41J/2/01 |
| JP | 2000351205 A | * | 12/2000 | ..... B41J/2/01 |
| JP | 2001030519 A | * | 2/2001 | ..... B41J/2/18 |

OTHER PUBLICATIONS

Machine translation of JP 05–84991 from Japanese Patent Office website.*

Machine translation of JP 05–131620 from Japanese Patent Office website.*

Machine translation of JP 2000–351205 from Japanese Patent Office website.*

*Primary Examiner*—Daniel J. Colilla
(74) *Attorney, Agent, or Firm*—Hamilton, Brook, Smith & Reynolds, P.C.

(57) ABSTRACT

A printing system that includes a web guide having a preprinting section which guides a substrate into the printing system, and a postprinting section which maintains tension in the substrate as the substrate moves through the printing system. A printing section is positioned between the preprinting section and the postprinting section. The printing section includes a removable platen to provide a gap in the printing section to prevent excess ink which is deposited onto the substrate from accumulating underneath the substrate.

27 Claims, 10 Drawing Sheets

U.S. PATENT DOCUMENTS 3,995,551 A 12/1976 Mitter
4,023,894 A 5/1977 Goel
4,043,665 A 8/1977 Caldwell
4,266,231 A 5/1981 Drago et al.
4,628,814 A 12/1986 Klemm
4,751,528 A * 6/1988 Spehrley et al. ..... 347/18
4,769,652 A 9/1988 Cleary et al.
4,847,635 A 7/1989 Jackson et al.
4,943,045 A 7/1990 Van Horne et al. ..... 271/277
4,982,207 A 1/1991 Tunmore et al. ..... 346/138
5,067,705 A 11/1991 Van Horne et al. ..... 271/277
5,079,980 A 1/1992 Oakes et al.
5,118,208 A 6/1992 Kitahara et al.
5,124,728 A 6/1992 Denda
5,136,316 A 8/1992 Punater et al.
5,195,836 A 3/1993 Longust et al.
5,232,141 A 8/1993 Mittmeyer et al.
5,263,414 A 11/1993 Lehrrieder et al.
5,302,037 A 4/1994 Schoendienst et al.
5,363,129 A 11/1994 Kline et al.
5,442,420 A 8/1995 Tsuji
5,479,199 A * 12/1995 Moore et al. ..... 347/102
5,510,822 A 4/1996 Vincent et al. ..... 347/102
5,517,912 A 5/1996 Winter
5,579,693 A 12/1996 Carreira et al.
5,592,202 A 1/1997 Erickson
5,664,495 A 9/1997 Winter
5,717,446 A 2/1998 Teumer et al.
5,742,315 A * 4/1998 Szlucha et al. ..... 347/102
5,751,303 A * 5/1998 Erickson et al. ..... 347/16
5,751,308 A 5/1998 Gandy et al.
5,857,605 A 1/1999 Welch et al.
5,883,654 A 3/1999 Katsuyama
5,901,646 A 5/1999 Walker et al.
5,904,429 A 5/1999 Goodwin et al.
5,906,158 A 5/1999 Takai
5,984,464 A 11/1999 Steinfield et al.
6,173,649 B1 * 1/2001 Onishi ..... 101/483
6,196,672 B1 3/2001 Ito et al. ..... 347/88
6,238,114 B1 5/2001 Bennett, III et al.
6,261,008 B1 7/2001 Omura
6,263,657 B1 7/2001 Fietz
6,276,778 B1 8/2001 Katayama
6,290,332 B1 9/2001 Crystal et al.
6,315,404 B1 11/2001 Wotton et al. ..... 347/102
6,328,439 B1 * 12/2001 Rhodes ..... 347/102
6,336,722 B1 1/2002 Wotton et al.
6,357,869 B1 3/2002 Rasmussen et al.
6,394,596 B1 5/2002 Wotton et al.
6,409,332 B1 6/2002 Yraceburu et al.
6,425,580 B1 7/2002 Yaneda
6,508,529 B2 1/2003 Rasmussen et al.
2002/0071016 A1 * 6/2002 Wotton et al. ..... 347/102
2002/0135653 A1 * 9/2002 Otsuki ..... 347/104

* cited by examiner

PRINTING SYSTEM WEB GUIDE WITH A REMOVABLE PLATEN

RELATED APPLICATION

This application is a continuation-in-part of U.S. application Ser. No. 10/040,894, filed Jan. 7, 2002 now abandoned, which claims the benefit of U.S. Provisional Application No. 60/260,308, filed on Jan. 8, 2001, the entire teachings of which are incorporated herein by reference.

BACKGROUND

Certain types of printing systems are adapted for printing images on large-scale substrates, such as for museum displays, billboards, sails, bus boards, banners, and the like. The substrate can be a web or mesh-like material. In some of these systems, the web is fed along its length into the printing system. A carriage which holds a set of print heads scans across the width of the web while the print heads deposit ink as the web moves.

In many systems, a web guide directs the web through the printing system. The web guides generally include multiple sections coupled together. Some of these sections can be heated to condition the web prior to printing and to dry off the ink solvents after the image is printed. Furthermore, the systems are usually provided with a mechanism which keeps the web under tension to prevent it from wrinkling or bunching up.

SUMMARY OF THE INVENTION

During the printing process, it is desirable for the web to move across a smooth outer surface of the web guide. However, in some circumstances, ink falls though the holes of the web and builds up underneath the web during the printing process. As such, the ink becomes smeared between the web and the web guide. The present invention implements a web guide which prevents ink build up and smearing.

In one embodiment, a printing system includes a web guide having a preprinting section which guides a substrate into the printing system, and a postprinting section which maintains tension in the substrate as the substrate moves through the printing system. A printing section is positioned between the preprinting section and the postprinting section. The printing section includes a removable platen to provide a gap in the printing section to prevent excess ink which is deposited onto the substrate from accumulating underneath the substrate.

Some embodiments can include one or more of the following features. The preprinting, printing, and postprinting sections can be heated, for example, by heating elements located underneath the outer surfaces of these sections. The heating of the substrate in the preprinting section conditions the substrate before ink is deposited on the substrate, while the heating process in the printing and postprinting section drys off any solvent in the ink deposited on the substrate.

The preprinting section can have a substantially flat surface over which the substrate moves. Additionally or alternatively, the postprinting section can have a convex shaped surface over which the substrate moves to apply a tension to the substrate.

The printing section can be connected to vacuum source which generates a suction on the substrate. In certain embodiments, the platen and the preprinting section define a first slot, and the platen and the postprinting section define a second slot. These slots can be in fluid communication with the vacuum source so that the suction on the substrate is generated through the first and second slots.

In certain embodiments, the printing section includes a trough in which the excess ink is collected when the platen is removed. There can be a drain located at the bottom of the trough for draining the excess ink. Additionally or alternatively, there can be an absorber located at the bottom of the trough for absorbing the excess ink.

Related embodiments include a method of guiding a substrate through a printing system. A preprinting system guides a substrate to a printing section of the printing system where a vacuum is applied to the substrate to minimize wrinkling of the substrate. In addition a tension is applied to the substrate as the substrate moves through the printing system.

In yet another embodiment, a method of guiding a substrate includes guiding the substrate through a preprinting section of the printing system, and moving the substrate over a gap of a printing section of the printing system. The presence of the gap minimizes excess ink which is deposited on the substrate from accumulating underneath the substrate.

In the above methods, the substrate can be heated before ink is deposited on the substrate to condition the substrate. Additionally or alternatively, the substrate can be heated and/or after ink is deposited on the substrate to dry off any solvent in the ink.

Some embodiments may have one or more of the following advantages. The printing system can print on mesh-like or web materials as well as solid sheets. The platen is easily and quickly removable to accommodate various types of substrates. The web guide applies a desirable amount of tension to keep the substrate from wrinkling. Furthermore, in embodiments in which the web guide is heated, the desired tension maintains good thermal contact between the substrate and the web guide. The heated web guide conditions the substrate which helps control the spread of ink. Furthermore, the heated web guide aids in drying the solvent after the ink is deposited on the substrate. The vacuum generated along the edges of the platen further aid in minimizing the amount of wrinkling of the substrate.

By placing quickly and easily placing blocks in the trough area, the vacuum area length can be adjusted to fit various web widths to optimize the de-wrinkling effect of the vacuum. Also, since the vacuum is distributed evenly along a slot, vacuum applied to the substrate is consistent across the width of the substrate.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
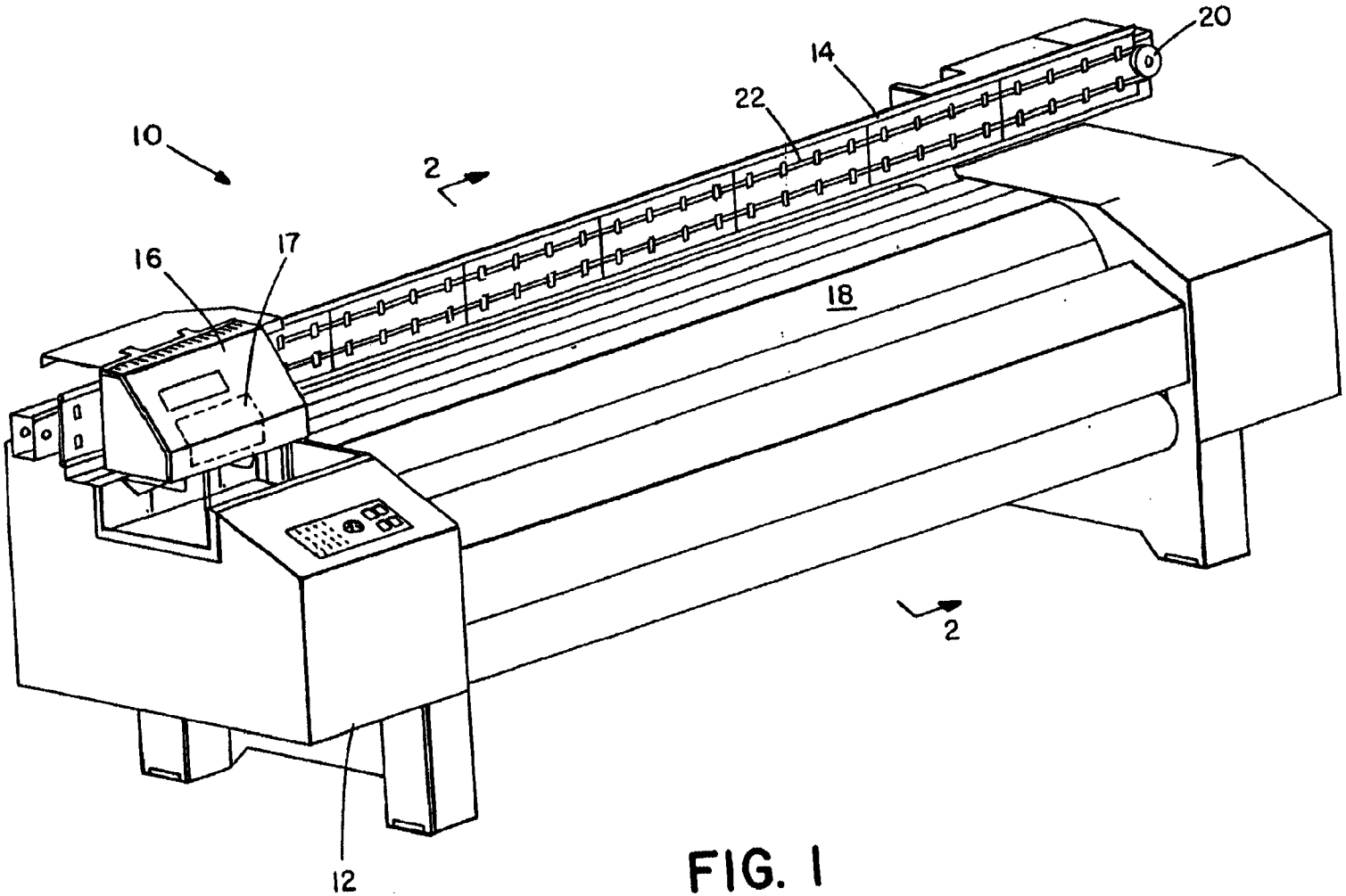
FIG. 1 is a perspective view of a printing system in accordance with an embodiment of the present invention.

Turning now to the drawings, there is shown in FIG. 1 a printing system 10, for example, a digital ink jet printing system, for printing images on large scale substrates such as webs, commonly referred to as scrims or meshes. These webs have holes with diameters that range from about 0.01 inch to about 0.25 inch. The webs are made, for example, from a plastic, such as polyvinyl or any other suitable material. An example of a web having holes is shown in FIG. 2B.

The printing system 10 includes a base 12, and a rail system 14 attached to the base 12. A carriage 16 which holds set of inkjet print heads 17 is mounted to the rail system 14, and a web guide 18 guides a substrate or web 28 (FIG. 2A) through the printing system 10. A pair of pulleys (of which only one pulley 20 is shown) are positioned on either end of the rail system 14. One of the pulleys, for example, the pulley 20 is connected to a carriage motor, and the carriage 16 is attached to a belt 22 which wraps around both pulleys. Accordingly, as the carriage motor rotates the pulley 20, the carriage 16 traverses back and forth along the rail system 14 while the print heads 17 deposit ink onto the web as it moves through the printing system 10 to create a desired image on the web.

Figures 2A, 2B:
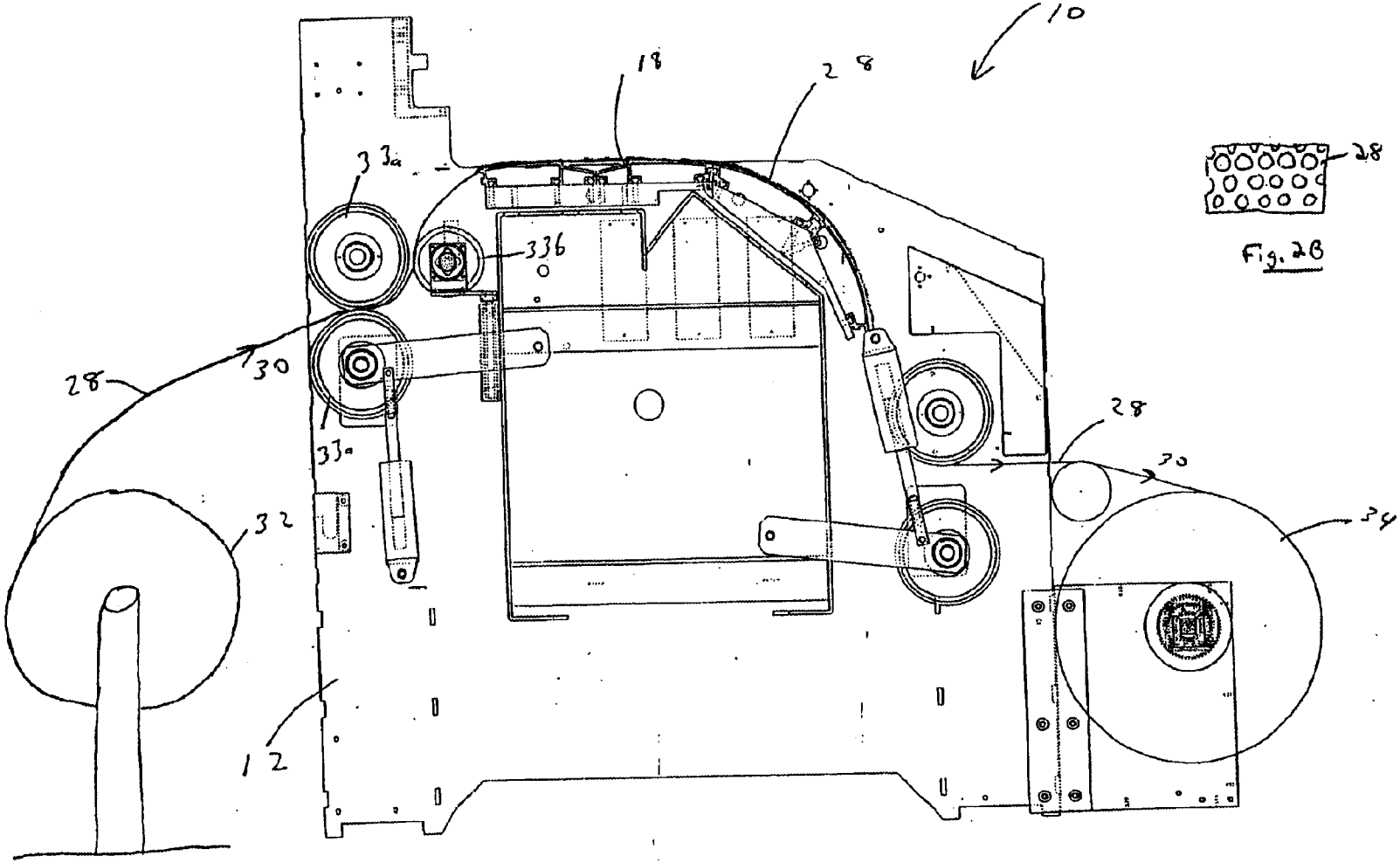
FIG. 2A is a cross-sectional side view of the printing system of FIG. 1 viewed along line 2—2 of FIG. 1.
FIG. 2B shows a web substrate having holes.

Referring to FIG. 2A, there is illustrated the path of the web 28 (indicated by arrows 30) as it is fed through the printing system 10. From a supply drum 32, the web 28 is guided through a pair of rollers 33*a* and over an additional roller 33*b* and then across the web guide 18. The web 28 is then is taken up by a take-up drum 34 attached to the printing system 10. The supply drum 32 actively feeds the web and includes a feedback mechanism to ensure that the web 28 is under tension. Alternatively, the web 28 can be supplied from a passive bar such that the take-up drum pulls 34 the web through the system.

Figure 3A:
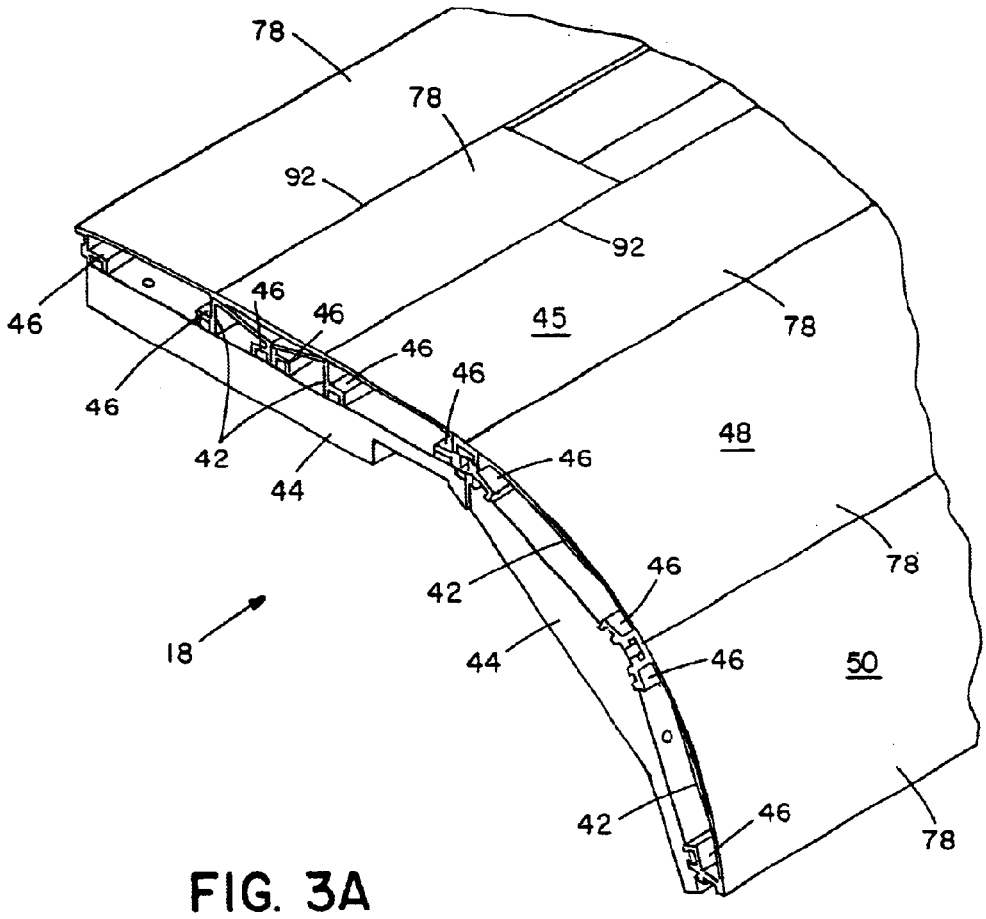
FIG. 3A is an perspective view of a web guide of the printing system of FIG. 1.
Figure 3B:
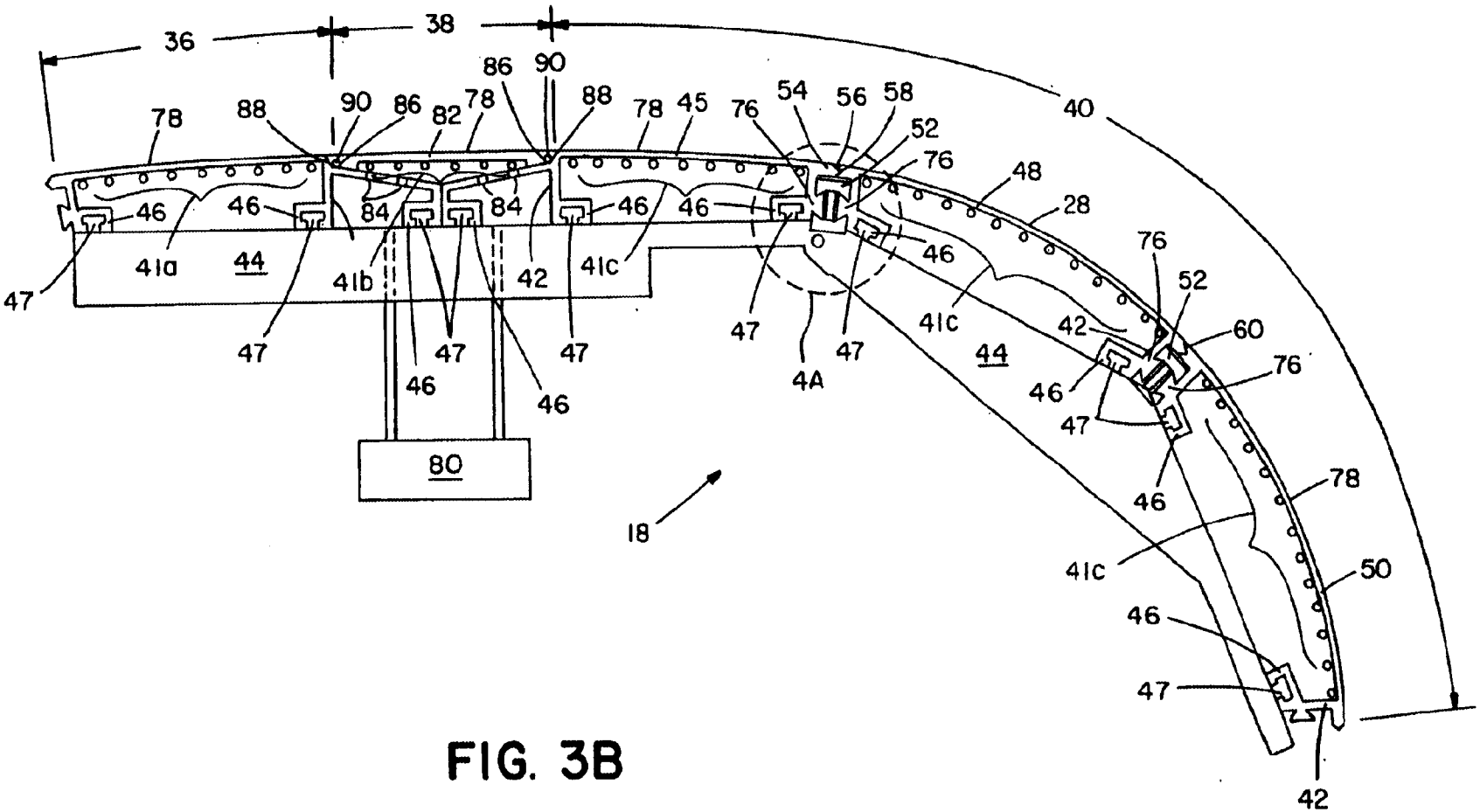
FIG. 3B is a side view of the web guide of FIG. 3A with a vacuum system.

Referring now to FIGS. 3A and 3B, the web guide 18 includes a preprinting section 36, a printing section 38, and a postprinting section 40. Each of these sections 36, 38, and 40 are provided with a multiplicity of heating elements 41*a*, 41*b*, and 41*c*, respectively, for example, resistive heating elements such as silicon strips positioned along the lengths of the sections. The sections can be heated from room temperature to about 300° F. The total heating capacity is about 5000 W. The heating capacity is adjustable, for example, to accommodate for different widths of the printing system 10, and hence the web guide 18. The total available power can be increased or decreased by changing the strips heaters 41*a*, 41*b*, and/or 41*c*. Additionally or alternatively, the heating capacity can be adjusted through temperature sensors and controllers.

The web 28 is heated in the preprinting section 36 and the printing section 38 conditions the web to control the spread of ink. The web is then heated in the postprinting section 40 to dry off solvents from the ink after the image is printed on the web 28. Note that heating the web in the printing section 38 can also help dry off the solvents in the ink.

As can readily been seen in FIGS. 3A and 3B, the postprinting section 40 is curved. By pulling the web 28 over this curved surface, a tension is maintained in the web 28. Further, this curvature increases the normal force on the web against the surface of the postprinting section 40 to ensure proper thermal contact between the web and this surface.

The sections 36, 38 and 40 are supported by a guide support structure 42 attached to a guide base 44. In particular, the guide support structure 42 is provided with T-slots 46 which are coupled with T-connectors 47 that are securely fastened to the guide base 44. Furthermore, the guide support structure 42 includes three subsections 45, 48, and 50 which support the postheating section 40. These three sections 45, 48, and 50 are clamped together by a set of bolt/dovetail nut assemblies 52. To ensure that these subsections 45, 48, and 50 are properly aligned, the subsection 45 is provided with a V-shaped edge 54 that fits into a V-shaped slot 56 of the subsection 48 to form a joint 58. An identical joint 60 is formed between the subsection 48 and the subsection 50. The T-slot 46/T-connector 47, the bolt/dovetail nut assemblies 52, and the joints 58 and 60 are used to create a uniform surface across the sections 36, 38, and 40 over which the web 28 moves.

Figure 4A:
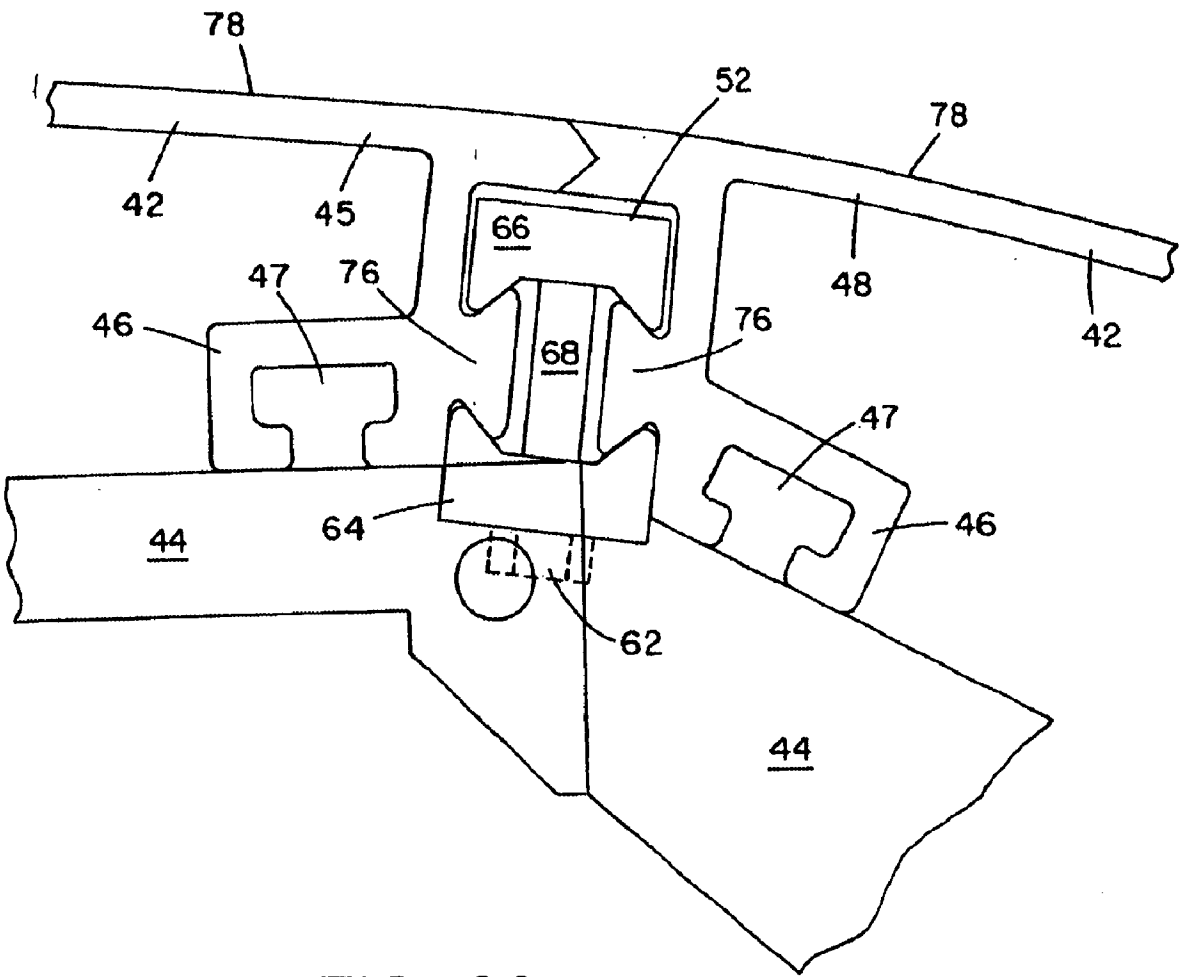
FIG. 4A is a close-up view of region 4A of FIG. 3A of two sections of the web connected by a connector assembly.
Figure 4B:
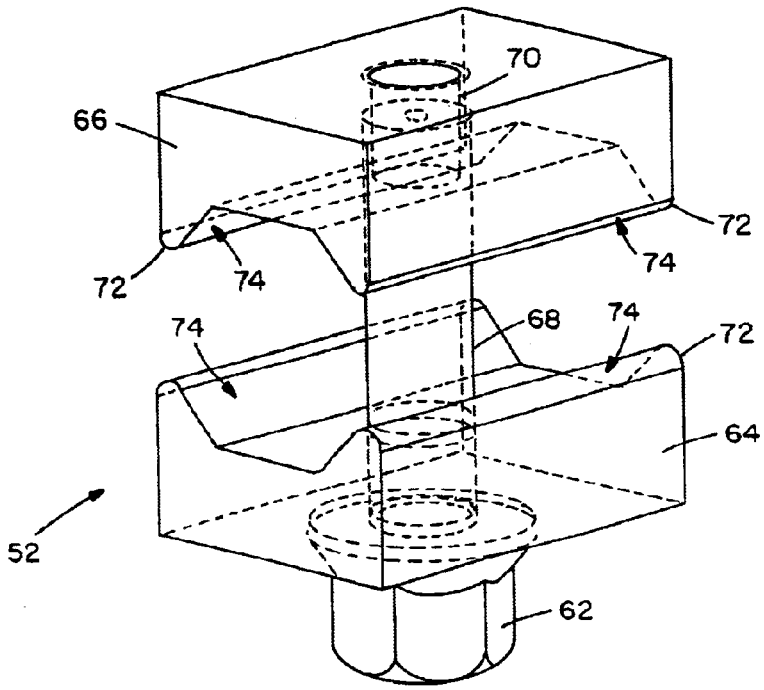
FIG. 4B is a perspective view of the connector assembly of FIG. 4A.

An individual bolt/dovetail nut assembly 52 is shown in greater detail in FIGS. 4A and 4B. Each bolt/dovetail nut assembly 52 includes a bolt 62, an annular dovetail nut 64, and a threaded dovetail nut 66. As a unit, the bolt/dovetail nut assembly 52 is assembled such that a shaft 68 of the bolt 62 passes through the annular dovetail nut 64 and a threaded end 70 of the bolt 62 engages with the threaded dovetail nut 66. Each of the annular dovetail nut 64 and the threaded dovetail nut 66 includes a pair of tapered edges 72. These tapered edges 72 define a pair of slots 74 which engage with flared connectors 76 of the subsections 45 and 48 (FIG. 4A), as well as the subsection 50 (FIG. 3B).

The guide support structure 42 and the web guide base 44 are, in certain embodiments, made from aluminum, and the T-connectors 47 are made from steel. The bolt 62, the annular dovetail nut 64, and the threaded dovetail nut 66 of the bolt/dovetail nut assemblies 52 are also made from steel in some embodiments. To further minimize friction between the web 28 and the web guide 18, the outer surface of the web guide 18 is coated with a low friction material 78, such as, for example, polytetrafluorethylene or any other suitable material.

Figure 5:
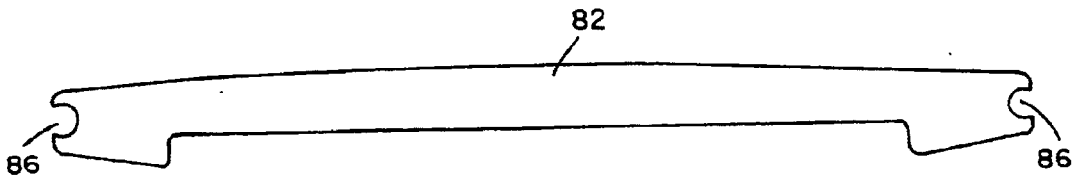
FIG. 5 is close-up side view of a removable platen of the web guide of FIGS. 3A and 3B.
Figure 6:
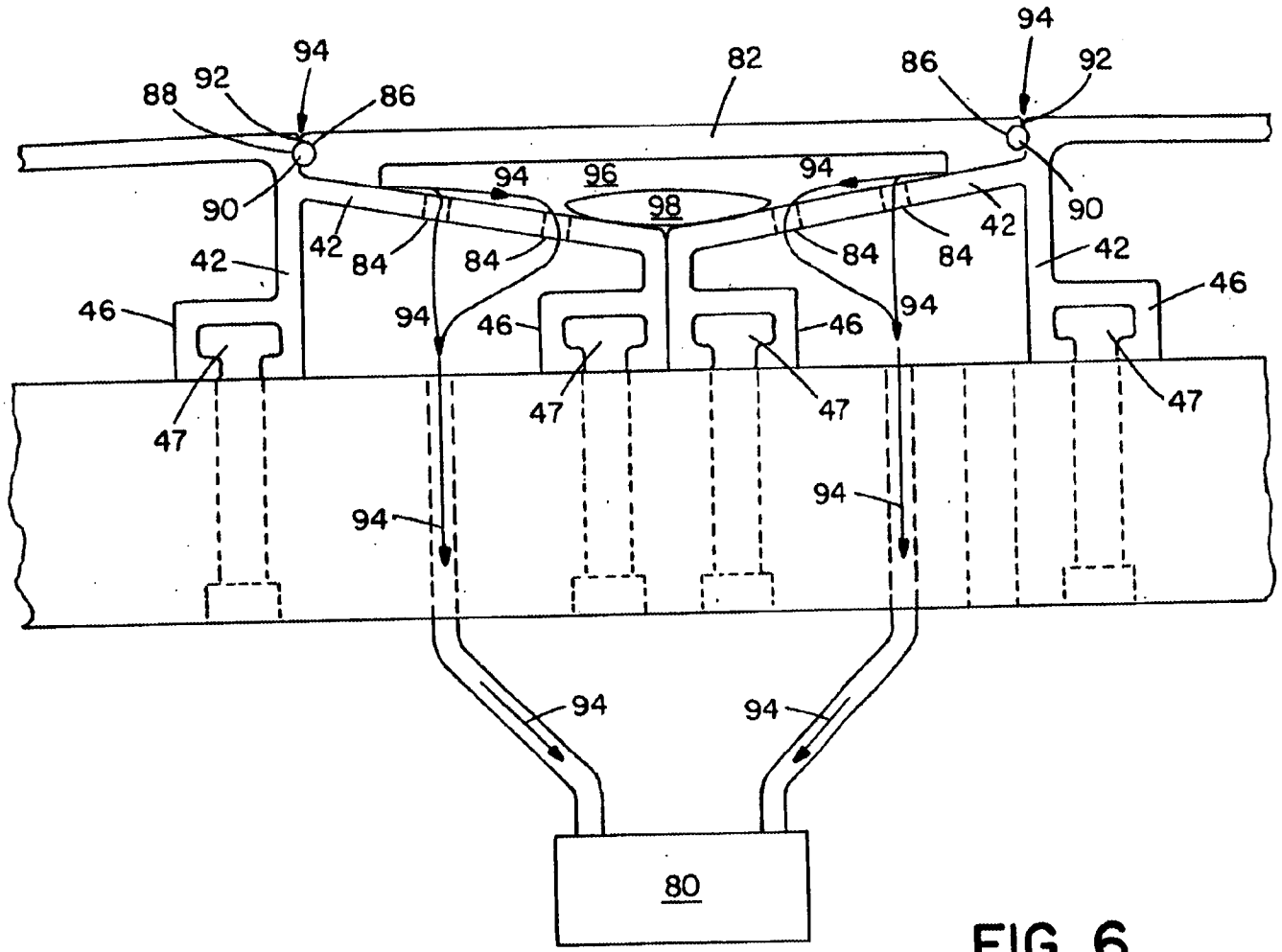
FIG. 6 is a close-up view of the printing section of the web guide of FIGS. 3A and 3B.

Referring back to FIG. 3B, the printing section 38 is connected to a vacuum generator or source 80 and includes a removable flat panel or platen 82 (FIG. 5). The platen 82 provides support for the web 28 as the print heads 17 deposit ink onto the web. Members of the guide support structure 42 located underneath the platen 82 include a set of holes 84 (FIG. 6) which provide a flow path through which the vacuum generator 80 draws a vacuum to the platen 82. The platen 82 is provided with a semicircular groove 86 on either side of the platen 82. There is a corresponding pair of grooves 88 on the preprinting section 36 and the postprinting section 40 of the guide support structure 42 which match with the grooves 86. When the platen 82 is in place, a pair of circular rods 90 made from, for example, an elastomer fit into the orifices defined by the grooves 86 and the respective grooves 88 to secure the platen 82 to the guide support structure 42. Further, the longitudinal sides of the platen 82 define with a corresponding edge of the support structure 42 a pair of narrow slots 92. When a vacuum is desired, the rods 90 are removed and the vacuum generator 80 draws a vacuum through the holes 84 and along the slots 92, as indicated by the arrows 94 in FIG. 6. The vacuum along the slots 92 generates a suction on the web 28 to minimize or prevent wrinkling of the web 28 as it moves across the printing section 38. Also, the suction draws the web 28 away from the print heads 17. This prevents contact between the web 28 and the print heads 17 and minimizes damage to the heads.

In use, the web 28 first moves through the preprinting section 36 of the web guide 18. Here, the heating elements 41*a* raise the temperature of the outer surface of the preprinting section 36 and consequently the web 28 to condition the web 28 prior to printing. As the web 28 intermittently moves through the printing section 38, the carriage 16 moves back and forth along the rail system 14 while the inkjet print heads 17 deposit ink onto the web. The web 28 then moves out of the printing section 38 and over the outer surface of the postprinting section 40. The heating elements 41*b* and 41*c* of the printing section 38 and the postprinting section 40, respectively, cause the temperature of the ink to increase thereby drying off the solvents in the ink. Finally, the take-up drum 34 rolls up the web 28 as the drum rotates. The rolled-up web 28 is easier to move for further processing or shipment to the customer.

In certain applications, the vacuum generator 80 is turned off and the platen 82 is removed so that the web 28 bridges a gap or trough 96 as the web moves through the printing section 38. This allows excess ink to fall into a cavity or trough 96 through the web to prevent excess ink buildup and smearing underneath the web 28. An absorber 98 located at the bottom of the trough 96 collects the excess ink in such applications. Additionally or alternatively, a drain plug can be located at the bottom of the trough to drain the excess ink. Note that when the vacuum generator 80 is in use and the platen 82 is in place, portions of the trough 96 can be closed off with a block or any other suitable device to draw the vacuum only across the width of the web.

While this invention has been particularly shown and described with references to preferred embodiments thereof, it will be understood by those skilled in the art that various changes in form and details may be made therein without departing from the scope of the invention encompassed by the appended claims.

Figure 7:
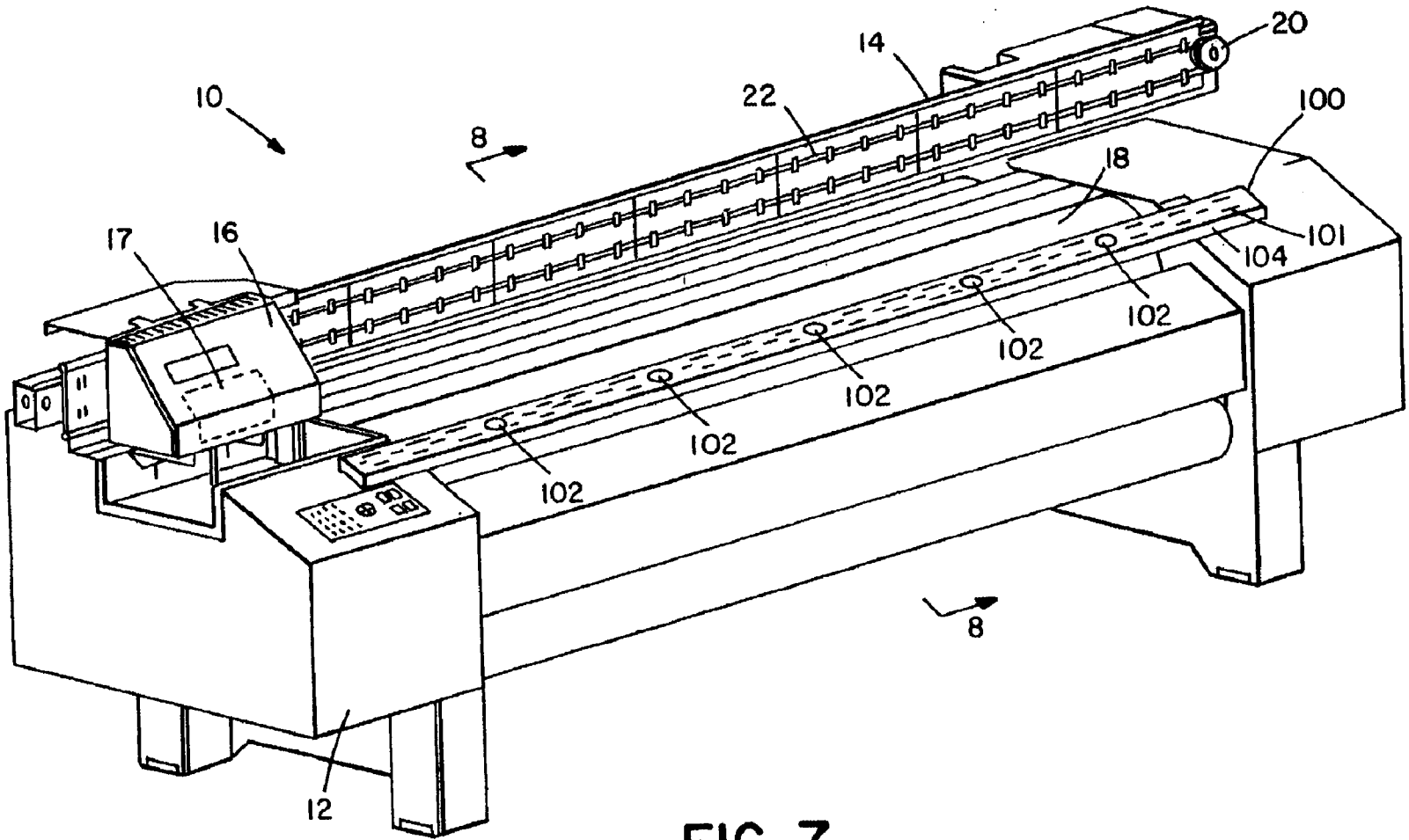
FIG. 7 is a perspective view of an alternative embodiment of the printing system in accordance with the present invention.
Figure 8:
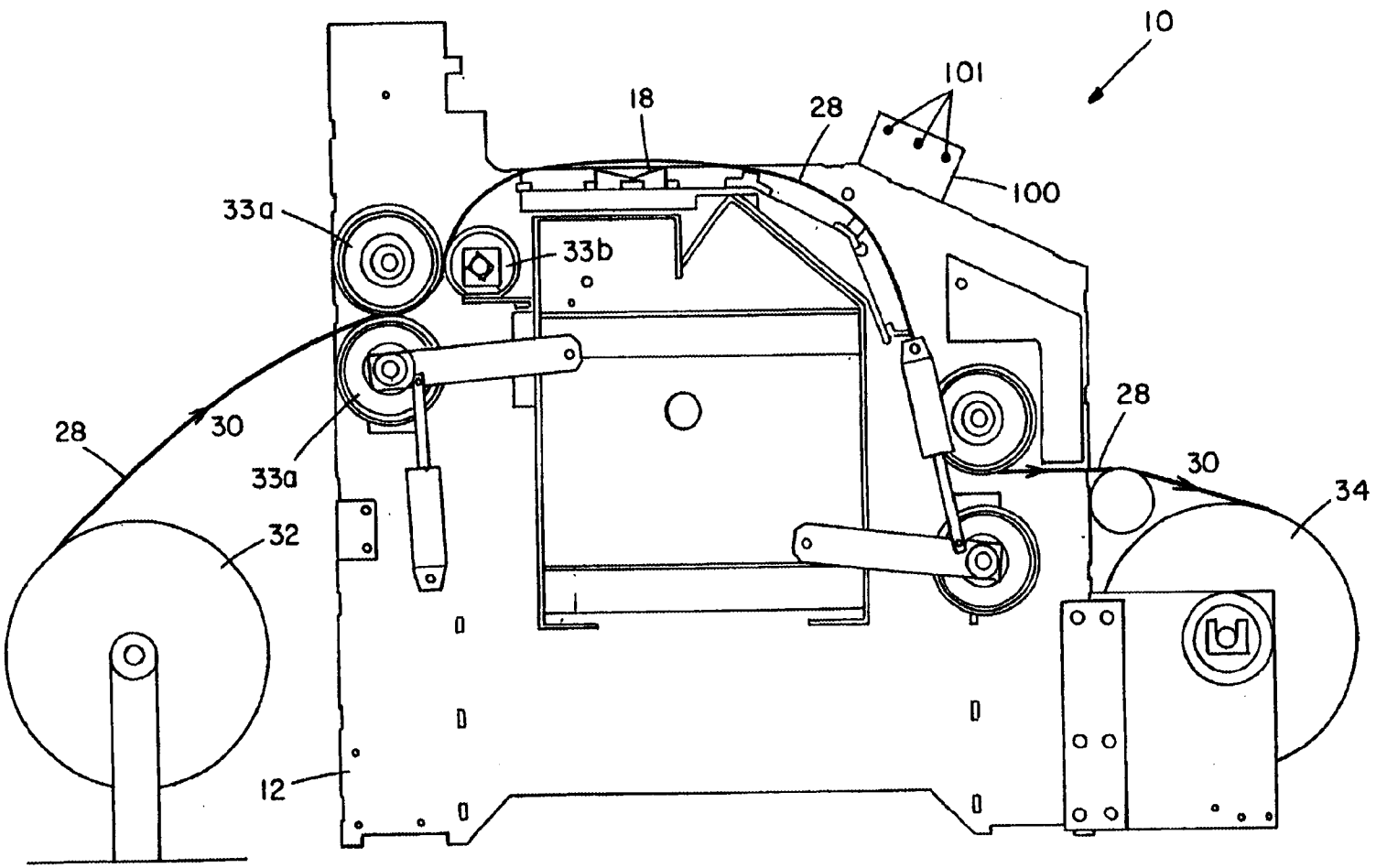
FIG. 8 is a cross-sectional side view of the printing of FIG. 7 viewed along the line 8—8 of FIG. 7.

For example, there is shown in FIGS. 7 and 8 a printing system 10 that includes a heater 100 mounted to the base 12. The heater 100 includes one or more infrared heating elements 101 enclosed within an housing 104 along the length of the heater 100. The heating elements 101, in one embodiment, emit infrared energy towards the ink deposited on the substrate or web as it moves underneath the heater 100. The heater 100 has a power output of about 5000 W, for example, for three-meter wide web guide. The available power can be adjusted so that the heater 100 can be used for web guides of different widths. To adjust the power output, the heating elements 101 can be changed to those with the appropriate power output, and/or the power can be adjusted through the use of temperature sensors and controllers.

Accordingly, the heater 100 alone or in combination with the heating elements 41*c* of the postprinting section 40 generates a sufficient amount of energy to dry off solvents from the deposited ink. In certain embodiments, the heater 100 also includes a series of fans 102 which blow air over the heating elements 101 such that heat is transmitted to the substrate or both by both radiative and convective heat transfer mechanisms from the heater 100. The fans 102 also help distribute the heat evenly to prevent hot spots from occurring on the substrate while driving off evaporating solvents.

Figure 9A:
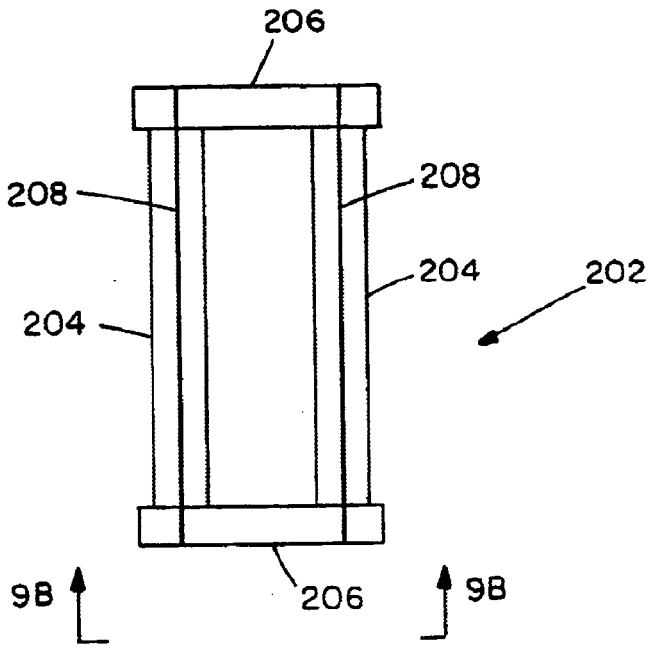
FIG. 9A is a top view of a cradle mechanism to provide a supply of web to the printing system.
Figure 9B:
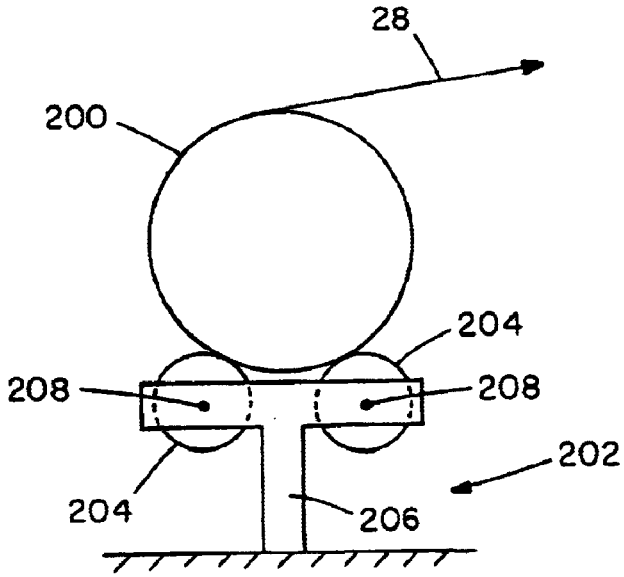
FIG. 9B is a side view of the cradle mechanism of FIG. 9A along the line 9B—9B.
Figures 2A, 2B:
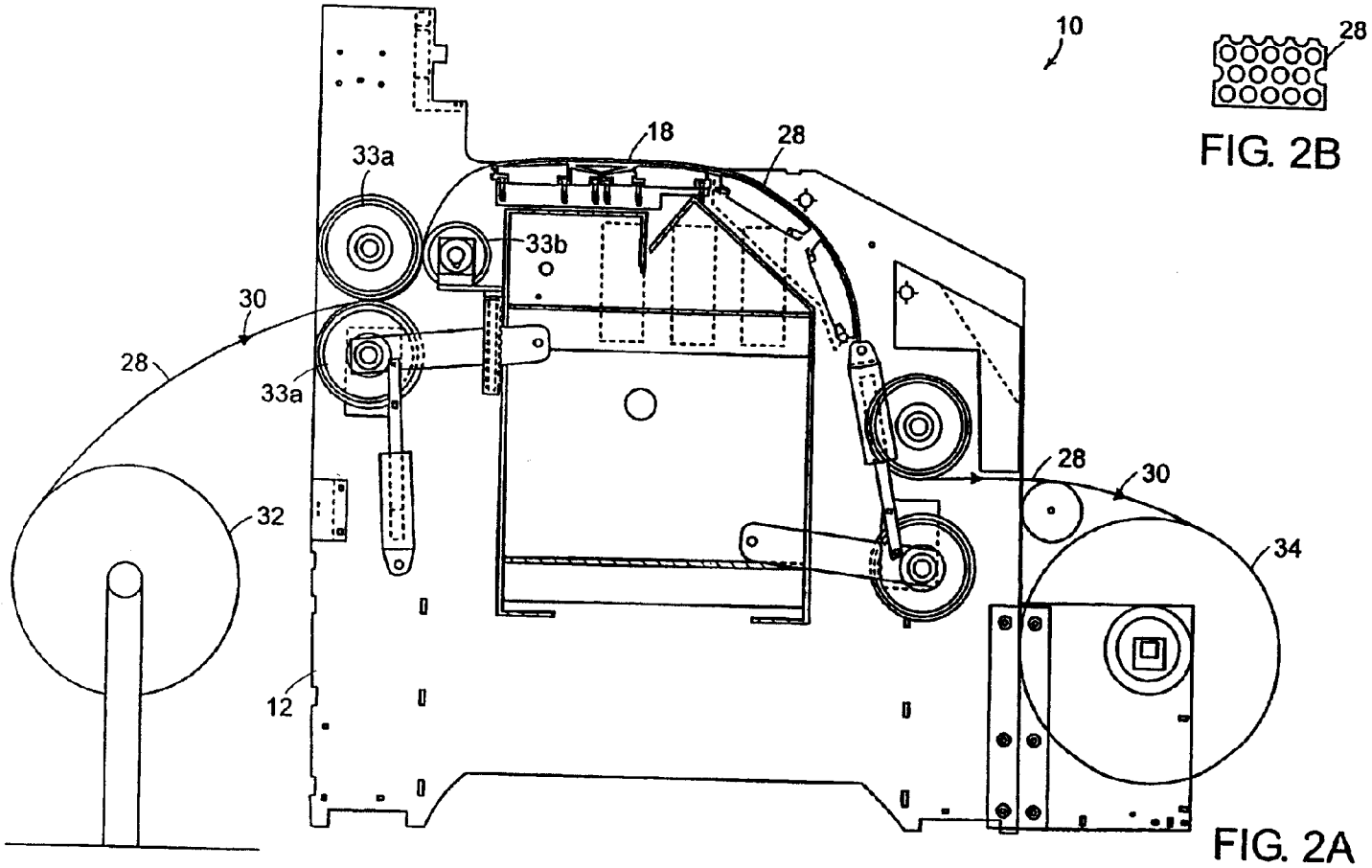

In some embodiments, the web 28 is supplied from a roll of web 200 supported by a cradle mechanism 202, as shown in FIGS. 9A and 9B. The cradle mechanism includes a pair of spaced apart rollers 204 supported by a pair of stands 206. In some arrangements, each roller 204 rotates about a stationary rod 208 secured at each end to a respective stand 206. Alternatively, rollers 204 can be fixed to the rods 208 such that the ends of the rods 208 rotate within bearings secured to the stands 206.

What is claimed is:

1. A printing system, comprising:

a web guide having a preprinting section which guides a substrate having a plurality of holes into the printing system;

a postprinting section which maintains tension in the substrate as the substrate moves through the printing system;

a printing section positioned between the preprinting section and the postprinting section, the printing section including a removable platen to provide a gap in the printing section to prevent excess ink which is deposited onto the substrate from accumulating on said platen and being transferred to the underside of a the substrate; and a trough within the gap in the printing section, the excess ink falling through the holes in the substrate collecting within the trough when the platen is removed.

2. The system of claim 1, wherein the preprinting section has a substantially flat surface over which the substrate moves.

3. The system of claim 2, wherein the preprinting section is heated to condition the substrate.

4. The system of claim 3, wherein the preprinting section includes heating elements to heat the substrate.

5. The system of claim 1, wherein the platen is heated to dry off solvents in the ink.

6. The system of claim 5, wherein the platen includes heating elements to heat the substrate.

7. The system of claim 1, wherein the postprinting section has a convex curved surface over which the substrate moves.

8. The system of claim 7, wherein the postprinting section is heated to dry off solvents in the ink.

9. The system of claim 8, wherein the postprinting section includes heating elements to heat the substrate.

10. The system of claim 1, wherein the printing section is connected to a vacuum source which generates a suction on the substrate.

11. The system of claim 10, wherein the platen and the preprinting section define a first slot, and the platen and the postprinting section define a second slot, the first slot and the second slot being in fluid communication with the vacuum source, the suction on the substrate being generated through the first and second slots.

12. The system of claim 1, further including a drain located at the bottom of the trough for draining the excess ink.

13. The system of claim 1, further including an absorber located at the bottom of the trough for absorbing the excess ink.

14. A printing system, comprising:

a web guide having a preprinting section which guides a substrate into the printing system, the preprinting section having a substantially flat surface over which the substrate moves, and including heating elements to condition the substrate;

a postprinting section which maintains tension in the substrate as the substrate moves through the printing system, the postprinting section having a substantially convex curved surface over which the substrate moves, and including heating elements to heat the substrate; and a printing section positioned between the preprinting section and the postprinting section, the printing section including a removable platen to provide a gap in the printing section to prevent excess ink which is deposited onto the substrate from accumulating underneath the substrate, the printing section including heating elements to heat the substrate and being connected to a vacuum source which generates a suction on the substrate.

15. The system of claim 14, wherein the substrate is a printable substrate having a plurality of openings therein through which the deposited ink may flow.

16. The system of claim 15, wherein at least some heating elements dry off the solvents from the deposited ink.

17. The system of claim 15, wherein the openings are in the range of 0.01 to 0.25 inches.

18. A method of guiding a substrate through a printing system, the substrate having openings extending transverse a longitudinal axis of the substrate comprising:

guiding the substrate through a preprinting section of the printing system;

moving the substrate through a printing section of the printing system wherein ink is deposited on the substrate, and applying a vacuum to the substrate to minimize wrinkling of the substrate;

collecting ink that falls through the openings of the substrate in a trough located within a gap in the printing section; and applying a tension to the substrate as the substrate moves through the printing system.

19. The method of claim 18, further comprising heating the substrate to condition the substrate before printing on the substrate.

20. The method of claim 18, further comprising heating the substrate in the printing section to dry off solvents from ink deposited on the substrate.

21. The method of claim 18, further comprising heating the substrate after printing on the substrate.

22. The method of claim 18, prior to guiding, removing a platen in the printing section to provide the gap in the printing section over which the substrate moves, the gap minimizing excess ink which is deposited on the substrate from accumulating underneath the substrate.

23. A method of guiding a printable substrate through a printing system wherein the substrate is formed with plural openings transverse a longitudinal axis of the substrate comprising:

guiding the substrate through a preprinting section of the printing system;

providing a gap in a printing section of the printing system by removing a platen member from said printing section;

moving the substrate over the gap of the printing section of the printing system, the gap minimizing excess ink which is deposited on the substrate from accumulating through said openings and forming underneath the substrate; and collecting ink that falls through the openings of the substrate in a trough located within the gap.

24. The method of claim 23, further comprising applying a tension to the substrate as the substrate moves through the printing system.

25. The method of claim 23, further comprising heating the substrate to condition the substrate before printing on the substrate.

26. The method of claim 23, further comprising heating the substrate in the printing section to dry off solvents from ink deposited on the substrate.

27. The method of claim 23, further comprising heating the substrate after printing on the substrate.

* * * * *

UNITED STATES PATENT AND TRADEMARK OFFICE

CERTIFICATE OF CORRECTION

PATENT NO. : 6,857,803 B2
DATED : February 22, 2005
INVENTOR(S) : Daniel E. Smith It is certified that error appears in the above-identified patent and that said Letters Patent is hereby corrected as shown below:

Drawings,
Replace sheet 2 of 10 (Figs 2A and 2B with the attached.

Column 6,
Line 31, delete "platen and being transferred to the underside of a the" and insert -- platen and being transferred to the underside of the --.

Signed and Sealed this

Twenty-fourth Day of January, 2006

JON W. DUDAS
*Director of the United States Patent and Trademark Office*

10
28

34
30
28

28
18
33b
33a
33a
30
28
32
12